US006340400B1

(12) United States Patent
Zhou

(10) Patent No.: US 6,340,400 B1
(45) Date of Patent: Jan. 22, 2002

(54) STAINLESS STEEL

(75) Inventor: Xiao Bo Zhou, Nieuwegein (NL)

(73) Assignee: SKF Engineering & Research Centre B.V., Nieuwegein (NL)

( * ) Notice: Subject to any disclaimer, the term of this patent is extended or adjusted under 35 U.S.C. 154(b) by 0 days.

(21) Appl. No.: 09/646,954

(22) PCT Filed: Mar. 26, 1999

(86) PCT No.: PCT/NL99/00173

§ 371 Date: Oct. 10, 2000

§ 102(e) Date: Oct. 10, 2000

(87) PCT Pub. No.: WO99/49094

PCT Pub. Date: Sep. 3, 1999

(30) Foreign Application Priority Data

Mar. 26, 1998 (NL) ..... 1008722

(51) Int. Cl.[7] ..... C21D 6/02; C22C 38/40

(52) U.S. Cl. ..... 148/605; 148/607

(58) Field of Search ..... 148/325, 326, 148/605, 607; 420/53, 54, 55

(56) References Cited

U.S. PATENT DOCUMENTS 2,916,337 A 12/1959 Fike et al.

FOREIGN PATENT DOCUMENTS

| | | | |
|---|---|---|---|
| DE | 24 47 137 A1 | | 4/1975 |
| EP | 0 295 111 A2 | | 12/1988 |
| JP | 60-210837 | | 10/1985 |
| JP | 07316748 | * | 12/1995 |
| JP | 090 87944 | * | 3/1997 |

* cited by examiner

*Primary Examiner*—Sikyin Ip
(74) *Attorney, Agent, or Firm*—Oliff & Berridge, PLC

(57) ABSTRACT

A stainless steel component comprising 0.8–1.4% carbon, 18–26 wt % chromium, 2–4 wt % nickel, 0–1 wt % molybdenum, 0 wt % lead and less than 0.6 wt % silicon provides for beneficial properties. Such a component may be prepared by the provision of an article from a steel starting material, and austenitizing the article between 800° C. and 1050° C. followed by hardening. In this process, the steel starting material comprises a powder.

11 Claims, No Drawings

STAINLESS STEEL

The present invention relates to a stainless steel having improved hardness and crack resistance whilst on the other hand corrosion resistance is not affected.

The most common stainless ball bearing steel known in the art is 440C. comprising about 0.95–1.20 wt % C., 16–18 wt % Cr, 0.75 wt % Mo, <1.0 wt % Si, <1.0 wt % Mn, <0.4 wt % P, <0.03 wt % S. Such a steel is austenitized at around 1040° C. after which it is hardened in a usual way. The final hardness is around HRC 58–60.

For some application this hardness is insufficient in the long term making a regular replacement of ball bearing components necessary. Replacement is always necessary if cracking occurs. This cracking originates from quenching.

A further use of 440C. steel is in tools. However, the same drawbacks in the use of ball bearing steels are found being in certain conditions insufficient wear resistance and the risk of introducing cracks during quenching.

The invention aims to provide a stainless steel having increased hardness without resulting in increased tendency of cracking.

According to the invention this is realized with a stainless steel comprising: 0.8–1.4 wt % C., 18–26 wt % Cr, 2–4 wt % Ni, 0–1 wt % Mo, 0 wt % Pb and <0.6 wt % Si. Because of the composition given above it is possible to lower the austenitizing temperature to below 1050° C. and more particular to below 1040° C., for example to 950° C. This lower austenitizing temperature saves heat treatment costs and it was found that it also did reduce the tendency of cracking during subsequent quenching the nickel percentage will have an effect on the structure to be obtained. According to the invention it is aimed to realize a fully austenitic structure in contrast to the prior art wherein some ferrite will be present. This austenite will during quenching be converted to martensite. If ferrite is present such a transformation will not automatically be observed. However, if the nicklel percentage is too high hardening will be affected.

The carbon percentage can be up to 1.4%. Above 1.4 carbon will result in hardening problems.

More particular the stainless steel described above comprises between 0.9 and 1.0 wt % C. The chromium percentage is preferably between 20–24 wt %. The stainless steel described above can be used for all imaginable applications, such as tools. However, a special use is in the field of ball bearings. It has been found that the corrosion resistance of the above stainless steel is sufficient because around 13–14 wt % Cr will be in solution of the FCC. phase if it is austenitized above about 840° C. Hardening can both be effected throughout the component to be prepared by furnace hardening or surface hardening can be used.

An article from the steel described above can be realized both by starting from a rolled item and machining or through powder metallurgy. The last method would be attractive if articles have to be made with complicated shape.

It is remarked that from the Japanese application 60-210837/62-70551 a steel powder is known used for production of valve seats. To that end Pb or Sn is introduced for self lubrication which was thought to be essential at that time for valve seats. There is no information about heat treatment and resulting hardness.

The invention will be further elucidated referring to the example below.

EXAMPLE

A steel having a composition of 0.95 wt % carbon, 22 wt % chromium, 3 wt % nickel and 0.2 wt % molybdenum was austenitized for 1 hour at 950° C. and quenched by 3 bar nitrogen, tempered at 150° C. and deep frozen at −70° C. and tempered at 220° C.

The Vickers hardness of the surface of a ball bearing component, made from this steel, was between $HV_1$ 860–890 (HRC 66–67).

The stainless steel mentioned above could be particularly used in applications wherein a laser melting treatment is not possible. However, it should be understood that the stainless steel mentioned above has many applications being within the range of the enclosed claims.

What is claimed is:

1. Method for preparing a stainless steel component consisting essentially of iron, 0.8–1.4 wt % carbon, 18–26 wt % chromium, 2–4 wt % nickel, 0–1 wt % molybdenum, 0 wt % lead and less than 0.6 wt % silicon, said method comprising the provision of an article from a steel powder starting material, and austenitizing the article between 800° C. and 970° C. followed by hardening.

2. Method according to claim 1, wherein said austenitizing is conducted between 930° C. and 970° C.

3. Method according to claim 1, wherein hardening comprises furnace hardening.

4. Method according to claim 1, wherein hardening comprises surface hardening.

5. Method according to claim 1, wherein hardening is effected such that the surface of the component has a hardness between HRC 60–70.

6. Method according to claim 5, wherein the hardness is about HRC 66–67.

7. Method according to claim 1, wherein said component comprises a ball bearing component.

8. Method according to claim 7, wherein hardening is effected such that the surface of the ball bearing component has a hardness between HRC 60–70.

9. Method according to claim 8, wherein the hardness is about HRC 66–67.

10. Method according to claim 1, said component comprising 0.9–1.0 wt % carbon.

11. Method according to claim 1, said component comprising 20–24 wt % chromium.

* * * * *